US012458147B2

(12) United States Patent
Lake et al.

(10) Patent No.: US 12,458,147 B2
(45) Date of Patent: Nov. 4, 2025

(54) ACTUATING MECHANISM OR SYSTEM FOR A POWERED FURNITURE SEATING PIECE

(71) Applicant: HIDDENLAKE 822, LLC, Tupelo, MS (US)

(72) Inventors: Stephen R. Lake, Tupelo, MS (US); Terry Dale Johnson, Baldwyn, MS (US)

(73) Assignee: HIDDENLAKE 822 LLC, Tupelo, MS (US)

( * ) Notice: Subject to any disclaimer, the term of this patent is extended or adjusted under 35 U.S.C. 154(b) by 90 days.

(21) Appl. No.: 18/229,131

(22) Filed: Aug. 1, 2023

(65) Prior Publication Data

US 2025/0040708 A1 Feb. 6, 2025

(51) Int. Cl.

| | |
|---|---|
| ***A47C 1/0355*** | (2013.01) |
| ***A47C 1/024*** | (2006.01) |
| ***A47C 1/12*** | (2006.01) |

(52) U.S. Cl.

CPC ..... *A47C 1/0355* (2013.01); *A47C 1/12* (2013.01)

(58) Field of Classification Search

CPC ..... A47C 1/0355; A47C 1/0345; A47C 1/024; A47C 1/034

See application file for complete search history.

(56) References Cited

U.S. PATENT DOCUMENTS

| | | | | |
|---|---|---|---|---|
| 3,819,229 A * | 6/1974 | Rogers, Jr | A61G 15/12 | 297/84 |
| 4,071,275 A * | 1/1978 | Rogers, Jr. | A47C 1/0355 | 297/86 |
| 4,249,772 A * | 2/1981 | Rogers, Jr. | A47C 1/0355 | 297/68 |
| 5,054,850 A * | 10/1991 | Pine | A47C 1/0345 | 297/89 |
| 5,087,094 A * | 2/1992 | Rogers, Jr. | A47C 1/0355 | 297/69 |
| 5,570,930 A * | 11/1996 | LaPointe | A47C 1/0345 | 297/85 L |
| 10,213,020 B2 | 2/2019 | Lawson | | |
| 10,383,443 B2 | 8/2019 | Lawson | | |
| 10,390,621 B2 | 8/2019 | Lawson | | |
| 10,485,347 B2 | 11/2019 | Lawson et al. | | |
| 11,363,886 B2 | 6/2022 | Johnson | | |
| 2006/0061148 A1* | 3/2006 | Pollard | A47C 1/0355 | 297/85 M |
| 2006/0249993 A1* | 11/2006 | Rogers | A47C 1/0355 | 297/68 |
| 2024/0341479 A1* | 10/2024 | Murphy | A47C 1/0355 | |
| 2025/0000260 A1* | 1/2025 | Cai | A47C 1/0355 | |
| 2025/0040708 A1* | 2/2025 | Lake | A47C 1/0345 | |
| 2025/0040709 A1* | 2/2025 | Lake | A47C 1/0355 | |

* cited by examiner

*Primary Examiner* — Shin H Kim

(74) *Attorney, Agent, or Firm* — LAW OFFICES OF STEVEN W. WEINRIEB

(57) ABSTRACT

An actuating mechanism or system for moving components of a powered furniture seating piece, such as, for example, a seat section and a back support fixedly connected to the seat section, and an extendable footrest or leg support, between a first position or state at which the seat section and back support are not tilted or reclined, and the footrest or leg support is disposed at a retracted or closed position, and a second position or state at which the seat section and back support are both disposed at tilted or reclined positions, while the footrest or leg support is disposed at an extended position.

20 Claims, 7 Drawing Sheets

ACTUATING MECHANISM OR SYSTEM FOR A POWERED FURNITURE SEATING PIECE

FIELD OF THE INVENTION

Figure 1:
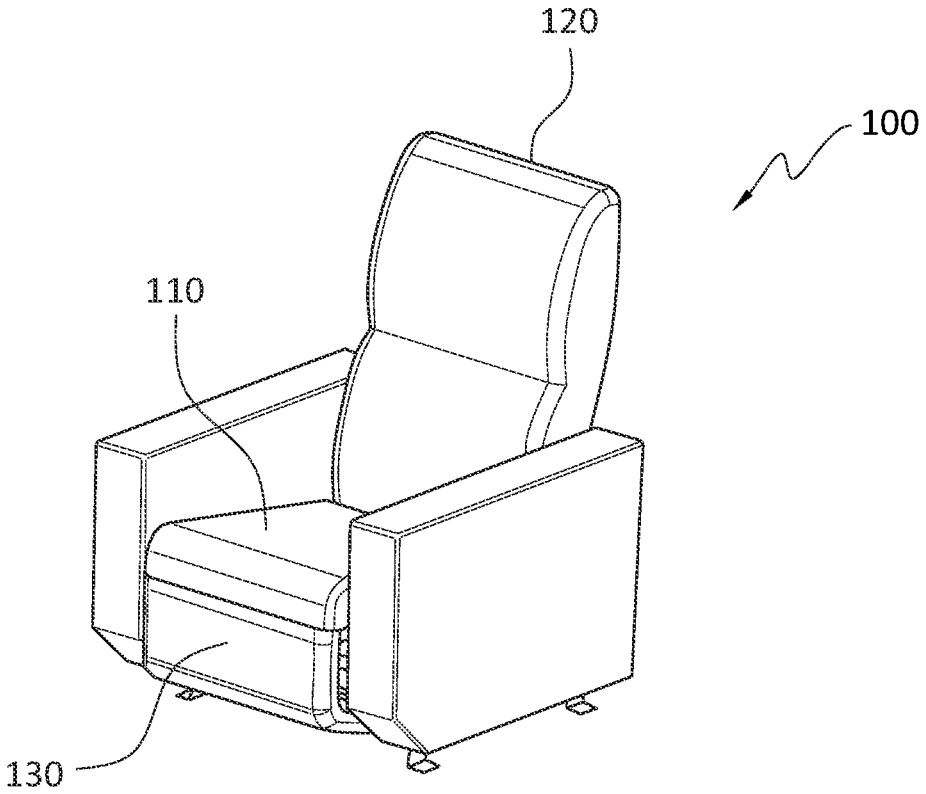
FIG. 1 (PRIOR ART)

The present invention relates generally to powered furniture seating, and more particularly to a new and improved actuating mechanism or system for moving components of a powered furniture seating piece, such as, for example, a seat section and a back support fixedly connected to the seat section, and an extendable footrest or leg support, between a first position or state at which the seat section and back support are not tilted or reclined, and the footrest or leg support is disposed at a retracted position, and a second position or state at which the seat section and back support are both disposed at tilted or reclined positions, while the footrest or leg support is disposed at an extended position. Still more particularly, the present invention is directed to a new and improved actuating mechanism or system for powered furniture seating wherein the powered furniture seating may comprise seating for a home or business, or seating for a theater or a stadium.

BACKGROUND OF THE INVENTION

Various different actuating mechanisms or systems for powered furniture seating pieces are of course well known in the art. Some examples of such actuating mechanisms or systems are disclosed within U.S. Pat. No. 10,213,020 which issued to Lawson on Feb. 26, 2019; U.S. Pat. No. 10,383,443 which issued to Lawson on Aug. 20, 2019; United States U.S. Pat. No. 10,390,621 which issued to Lawson on Aug. 27, 2019; U.S. Pat. No. 10,485,347 which issued to Lawson et al. on Nov. 26, 2019; and U.S. Pat. No. 11,363,886 which issued to Johnson on Jun. 21, 2022. It is noted that while all of these actuating mechanisms or systems are viably operative so as to move various components of the powered furniture seating between a multiplicity of positions, all of such actuating mechanisms or systems comprise relatively complicated, complex, redundant linkage mechanisms or systems which are costly to manufacture and difficult to assemble.

A need exists in the art for a new and improved actuating mechanism or system. Another need exists in the art for a new and improved actuating mechanism or system for use in connection with powered furniture seating pieces. Still another need exists in the art for a new and improved actuating mechanism or system for use in connection with powered furniture seating pieces wherein the powered furniture seating piece comprises theater or stadium seating. Yet another need exists in the art for a new and improved actuating mechanism or system for use in connection with powered furniture seating pieces wherein the powered furniture seating piece comprises theater or stadium seating, and wherein the new and improved actuating mechanism or system can move a seat section and a back support, fixedly connected to the seat section, and an extendable footrest or leg support, between a first position or state at which the seat section and back support are not tilted or reclined, while the footrest or leg support is disposed at a retracted position, and a second position at which the seat section and back support are disposed at tilted and reclined positions while the footrest or leg support is disposed at an extended position. Yet still another need exists in the art for a new and improved actuating mechanism or system for use in connection with powered furniture seating pieces wherein the powered furniture seating piece comprises theater or stadium seating, wherein the new and improved actuating mechanism or system comprises a simplified linkage assembly which can move a seat section and a back support, fixedly connected to the seat section, and an extendable footrest or leg support, between a first position or state at which the seat section and back support are not tilted or reclined, while the footrest or leg support is disposed at a retracted position, and a second position at which the seat section and back support are disposed at tilted and reclined positions while the footrest or leg support is disposed at an extended position, and wherein the simplified linkage assembly is cost effective to manufacture and easy to assemble.

OVERALL OBJECTIVES OF THE INVENTION

An overall objective of the present invention is to provide a new and improved actuating mechanism or system. Another overall objective of the present invention is to provide a new and improved actuating mechanism or system for use in connection with powered furniture seating pieces. Still another overall objective of the present invention is to provide a new and improved actuating mechanism or system for use in connection with powered furniture seating pieces wherein the powered furniture seating piece comprises theater or stadium seating. Yet another overall objective of the present invention is to provide a new and improved actuating mechanism or system for use in connection with powered furniture seating pieces wherein the powered furniture seating piece comprises theater or stadium seating, and wherein the new and improved actuating mechanism or system can move a seat section and a back support, fixedly connected to the seat section, and an extendable footrest or leg support, between a first position or state at which the seat section and back support are not tilted or reclined, while the footrest or leg support is disposed at a retracted position, and a second position at which the seat section and back support are disposed at tilted and reclined positions while the footrest or leg support is disposed at an extended position. Yet still another overall objective of the present invention is to provide a new and improved actuating mechanism or system for use in connection with powered furniture seating pieces wherein the powered furniture seating piece comprises theater or stadium seating, wherein the new and improved actuating mechanism or system comprises a simplified linkage assembly which can move a seat section and a back support, fixedly connected to the seat section, and an extendable footrest or leg support, between a first position or state at which the seat section and back support are not tilted or reclined, while the footrest or leg support is disposed at a retracted position, and a second position at which the seat section and back support are disposed at tilted and reclined positions while the footrest or leg support is disposed at an extended position, and wherein the simplified linkage assembly is cost effective to manufacture and easy to assemble.

SUMMARY OF THE INVENTION

The foregoing and other objectives of the present invention are achieved by a new and improved actuating mechanism or system for use in connection with powered furniture seating pieces wherein the actuating mechanism or system comprises a base or foundation, and a linear actuator having its motor or rear end pivotally mounted upon the base or foundation, while its oppositely disposed telescopic rod or forward end is pivotally connected to a front motor drive tube which is mounted upon an ottoman drive link that has a first end portion thereof pivotally mounted upon a seat rail. It is noted that the linear actuator may be a mechanical actuator, an electrical actuator, a hydraulic actuator, a pneumatic actuator, or any suitable combination thereof, such as, for example, an electromechanical actuator. Continuing further, a rear pivot link is pivotally connected at a first end thereof to a rear portion of the seat rail, while a second opposite end thereof is pivotally connected to or mounted upon the base or foundation. In a similar manner, a front pivot link is pivotally connected at a first end thereof to an intermediate portion of the seat rail, while a second opposite end thereof is pivotally connected to or mounted upon a front-end portion of the base or foundation. This structural interrelationship permits the seat rail to effectively slide forwardly and backwardly, with respect to the fixed base or foundation, when the components of the powered furniture seating, such as, for example, the seat section and the back support fixedly connected to the seat section, and the extendable footrest or leg support, are moved between a first position or state at which the seat section and the back support are not tilted or reclined, while the footrest or leg support is disposed at a retracted or closed position, and a second position at which the seat section and the back support are disposed at tilted and reclined positions while the footrest or leg support is disposed at an extended or fully open position. Still further, a control link is pivotally connected at a first end thereof to an intermediate portion of the front pivot link, while a second opposite end thereof is pivotally connected to a first end portion of an ottoman control link.

A first end portion of the ottoman control link is pivotally connected to or mounted upon the seat rail, at a location near the front-end portion of the seat rail, while a second opposite end portion of the ottoman control link is pivotally connected to a first end portion of a first ottoman extension link, a second opposite end portion of the first ottoman extension link being pivotally connected to a first end portion of an ottoman mounting bracket upon which an ottoman or footrest is to be mounted and supported. In turn, an intermediate portion of the first ottoman extension link is pivotally connected to an intermediate portion of the ottoman drive link, while a second end portion of the ottoman drive link is pivotally connected to a first end portion of a second ottoman extension link, a second opposite end portion of the second ottoman extension link being pivotally connected to an intermediate portion of the ottoman mounting bracket upon which the ottoman or footrest is to be mounted and supported. Therefore, it can be appreciated that as a result of the extension or contraction of the telescopic rod of the linear actuator, the components of the powered furniture seating, that is, the seat section and the back support fixedly connected to the seat section, and the extendable footrest or leg support, are capable of being moved between the first position or state at which the seat section and the back support are not tilted or reclined, while the footrest or leg support is disposed at a retracted or closed position, and the second position at which the seat section and the back support are disposed at tilted and reclined positions while the footrest or leg support is disposed at an extended or fully open position, and, in addition, the seat rail is effectively enabled to slide forwardly and backwardly, with respect to and upon the fixed base or foundation, when the components of the powered furniture seating are moving or traversing between the first and second positions.

BRIEF DESCRIPTIONS OF THE DRAWINGS

Figure 2:
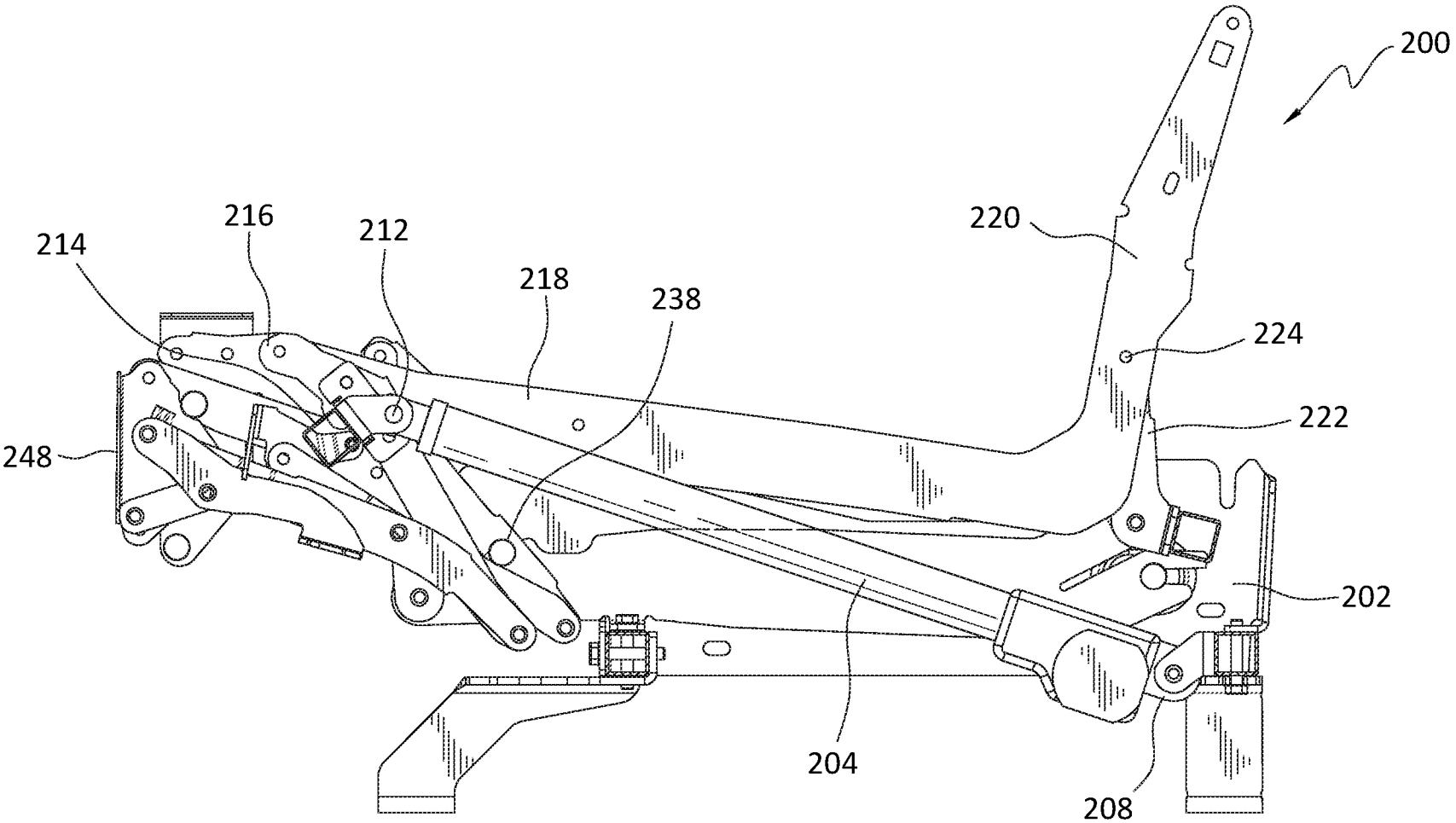
Figure 3:
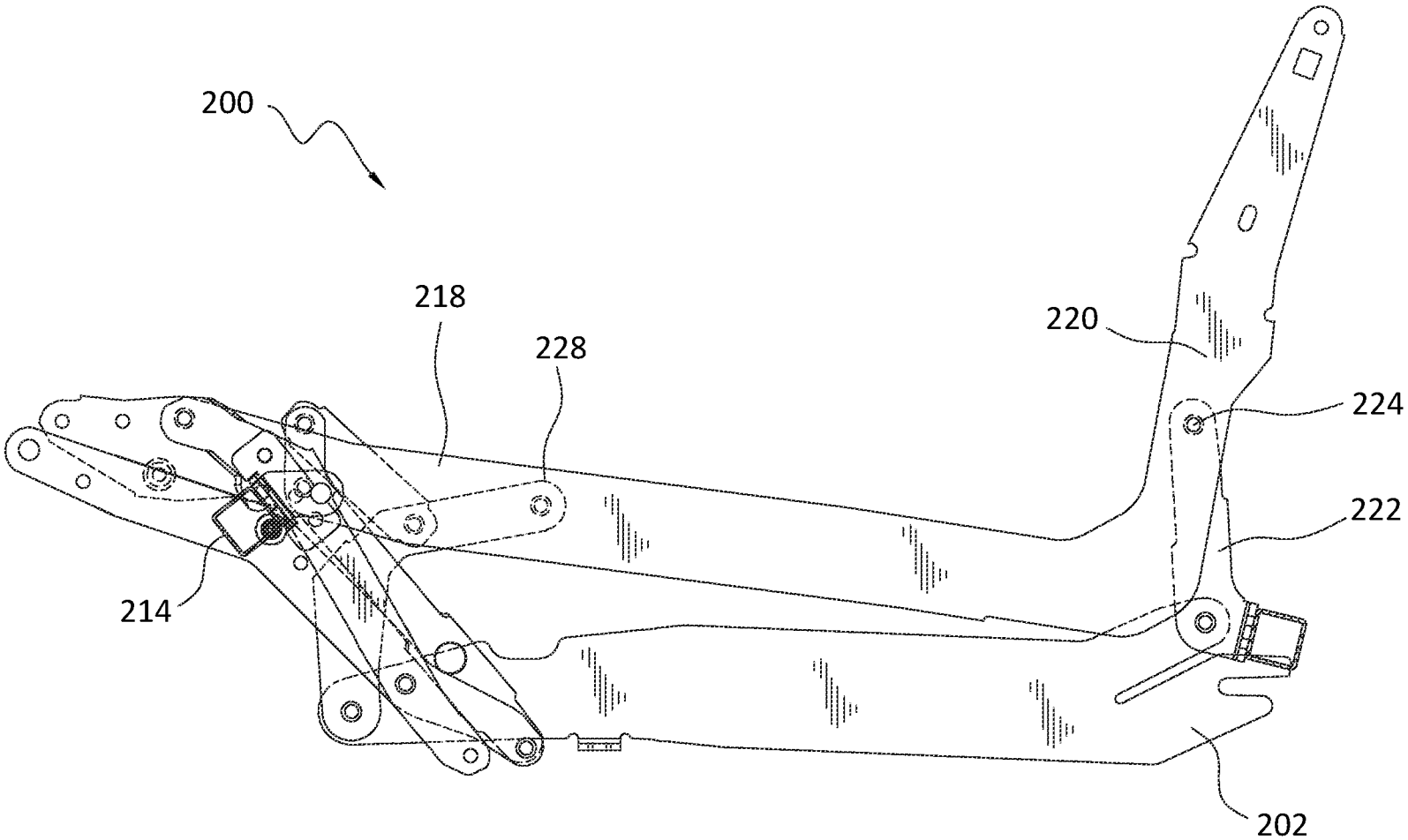
Figure 4:
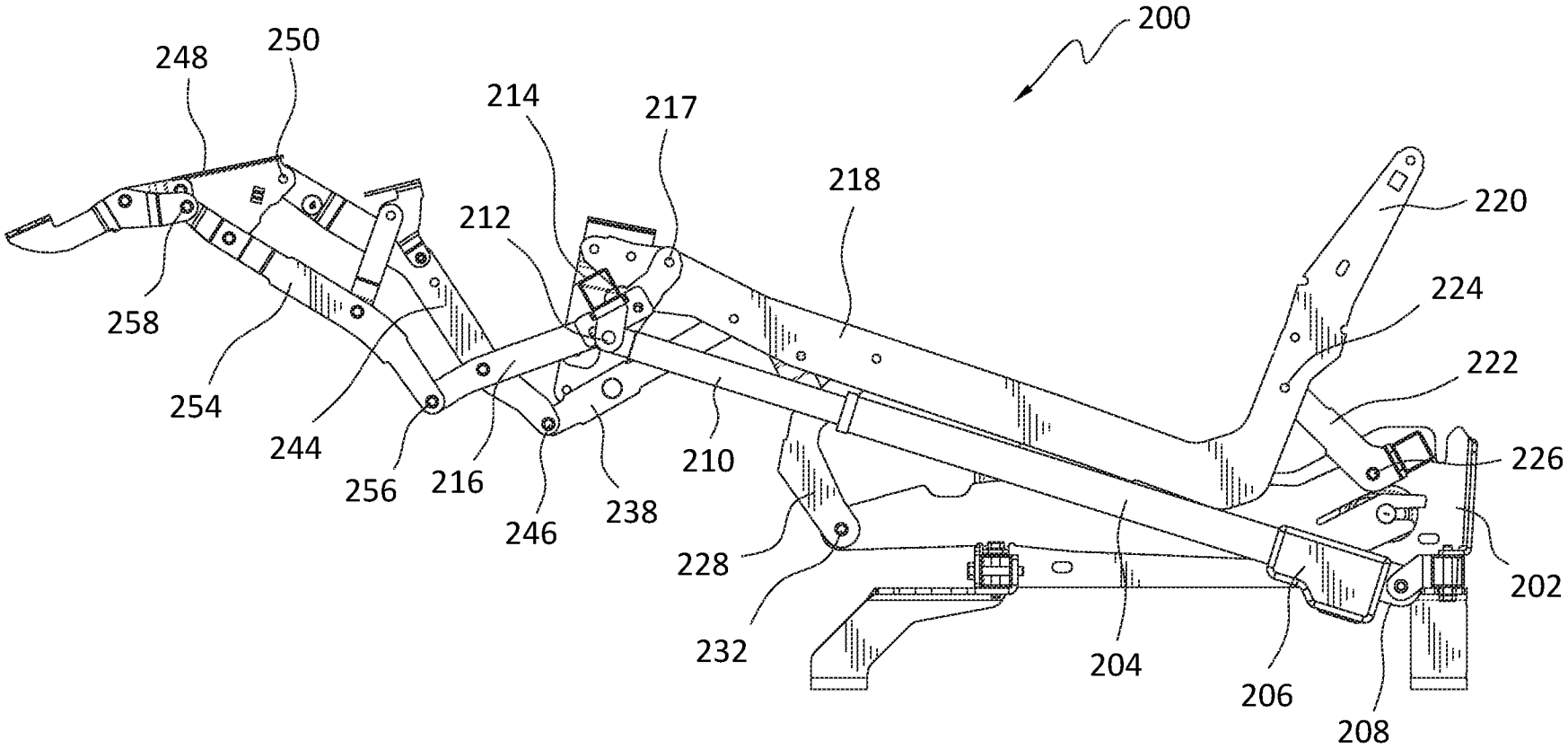
Figure 5:
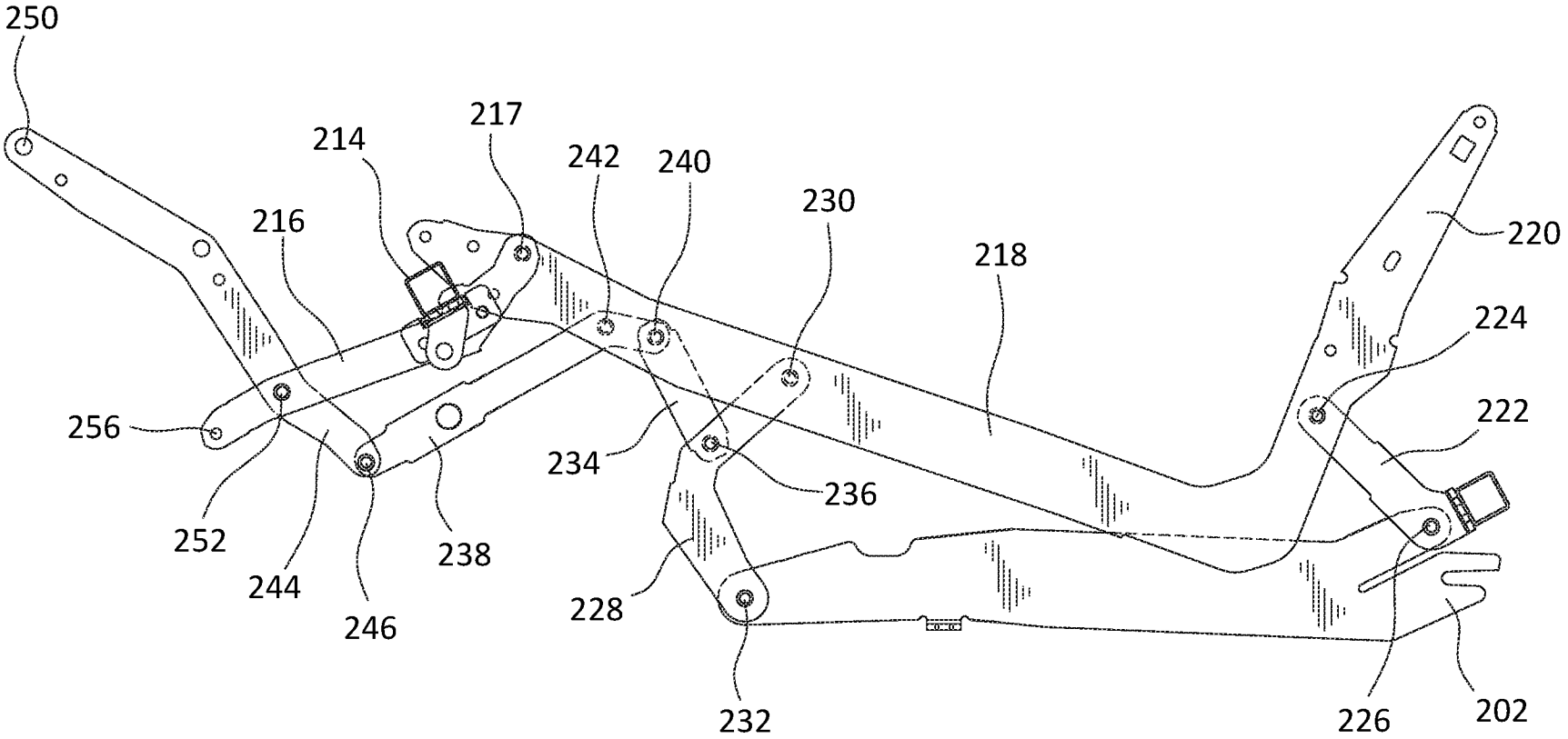
Figure 6D:
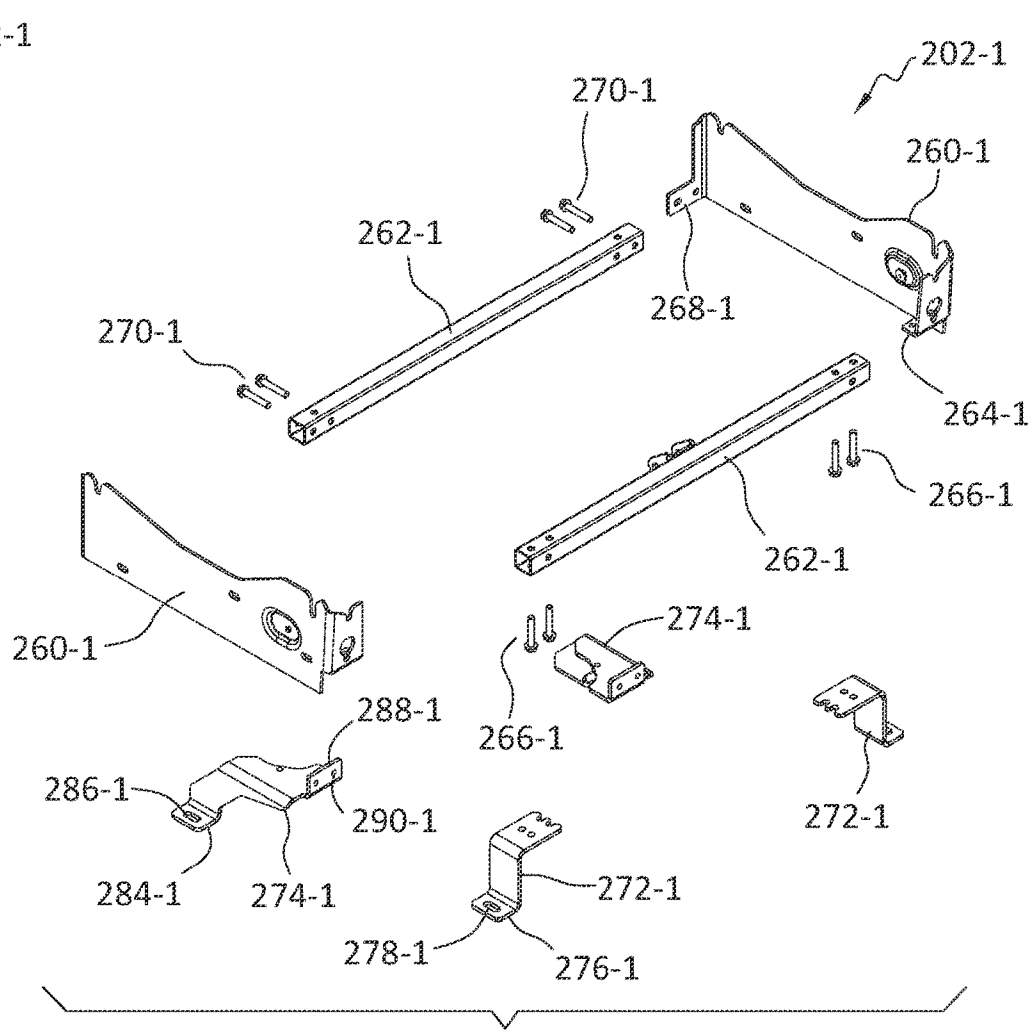
Figure 6A:
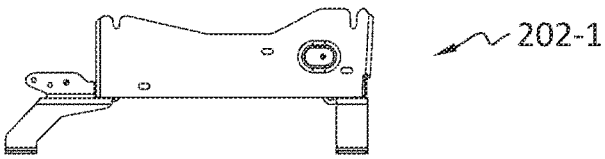
Figure 6B:
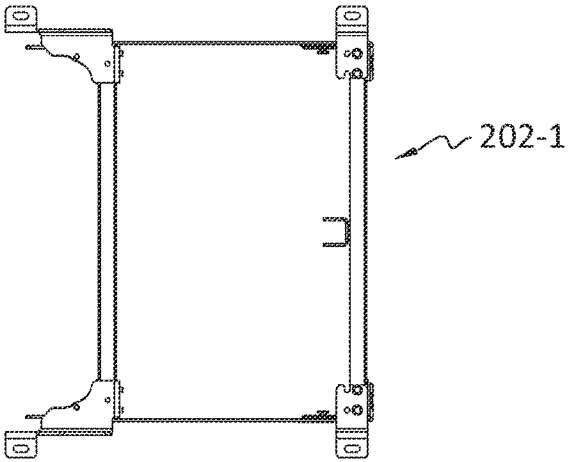
Figure 6C:
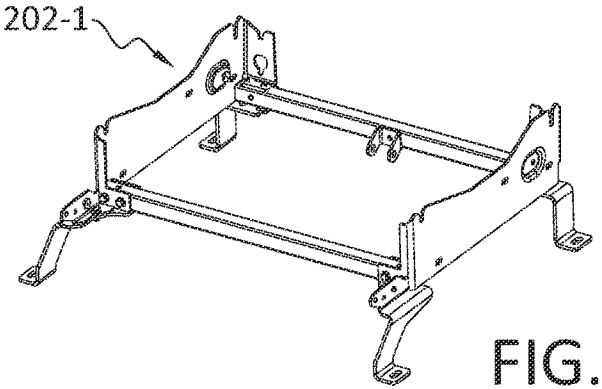
Figure 7A:
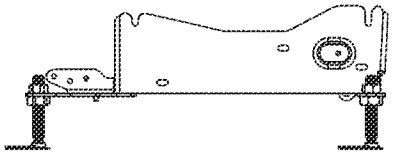
Figure 7B:
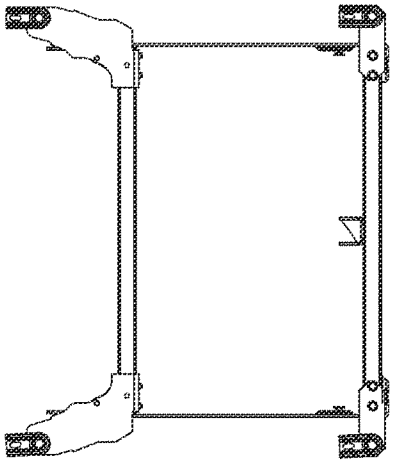
Figure 7C:
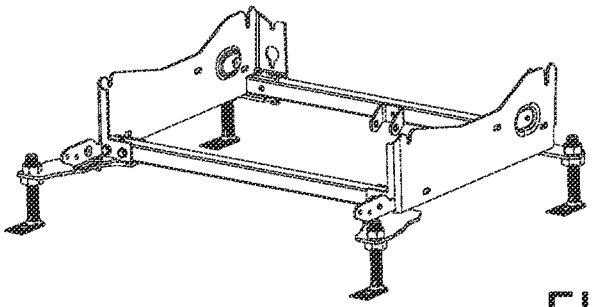
Figure 7D:
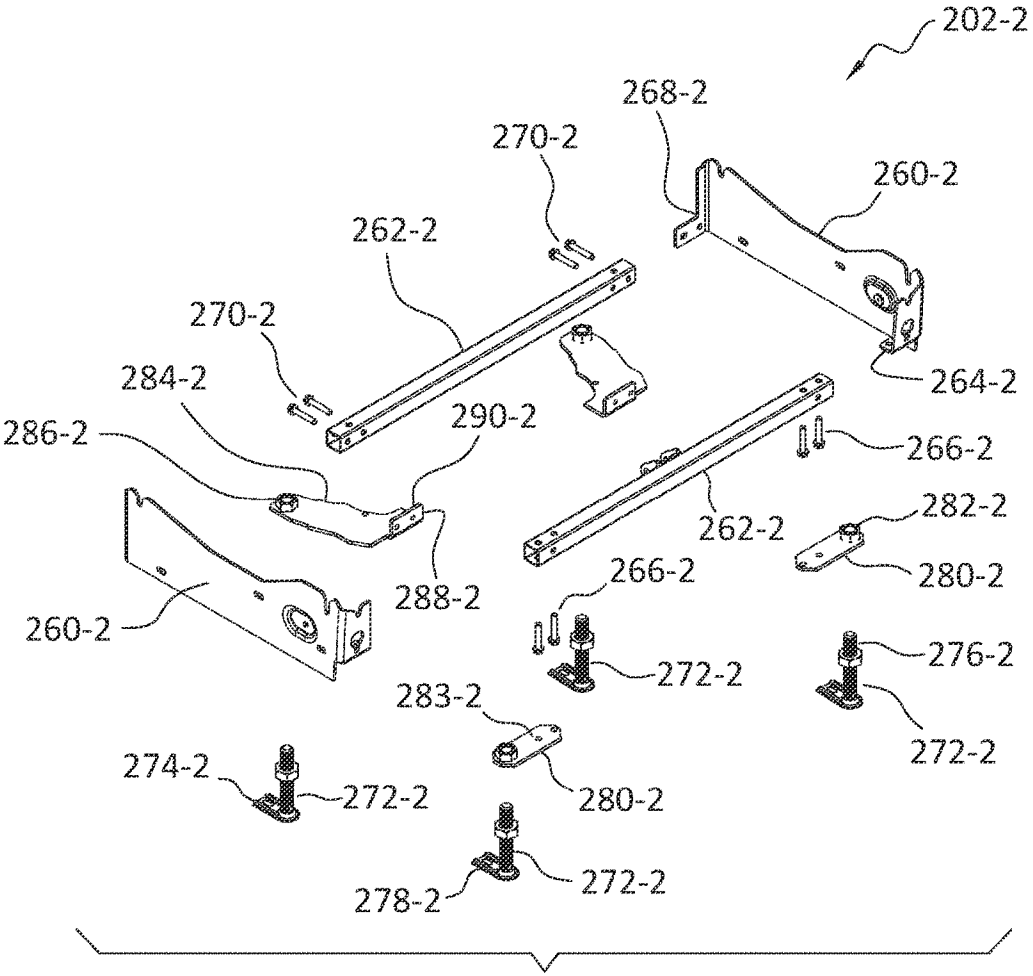

Various other features and attendant advantages of the present invention will be more fully appreciated from the following detailed description when considered in connection with the accompanying drawings in which like reference characters designate like or corresponding parts throughout the several views, and wherein:

FIG. 1 is a perspective view of a conventional, PRIOR ART, powered furniture seating piece which may be utilized within home offices, family rooms, dens, and the like, business offices or conference rooms, or theater or stadium seating environments, and wherein the powered furniture seating piece comprises a seat section, a back support, and an ottoman or footrest section, all of which are adapted to be moved between a first non-deployed position at which, for example, the seat section is disposed so as to have a substantially horizontal orientation, the back support is disposed at a fully upright position, and the ottoman or footrest section is disposed at a retracted or closed position, and a second deployed position at which, for example, the seat section is disposed so as to have a tilted orientation with the front of the seat section being elevated while the rear of the seat section is lowered, the back support is disposed at a reclined position, and the ottoman or footrest section is disposed at an extended or open position;

FIG. 2 is a side elevational view of a new and improved actuating mechanism or system for use within the powered furniture seating piece of FIG. 1, and wherein the linear actuator of the new and improved actuating mechanism or system is disposed at its retracted position such that the seat section is disposed so as to have a substantially horizontal orientation, the back support is disposed at a fully upright position, and the ottoman or footrest section is disposed at a retracted or closed position;

FIG. 3 is a side elevational view, similar to that of FIG. 2, showing, however, the new and improved actuating mechanism or system wherein some of the structural components have been removed for clarity purposes;

FIG. 4 is a side elevational view, similar to that of FIG. 2, showing, however, the new and improved actuating mechanism or system wherein the linear actuator of the new and improved actuating mechanism or system is disposed at its extended position such that the seat section is disposed so as to have a tilted orientation with the front of the seat section being elevated while the rear of the seat section is lowered, the back support is disposed at a fully reclined position, and the ottoman or footrest section is disposed at an extended or open position;

FIG. 5 is a side elevational view, similar to that of FIG. 4, showing, however, the new and improved actuating mechanism or system wherein some of the structural components have been removed for clarity purposes;

FIGS. 6A-6D are, respectively, side elevational, top plan, assembled perspective, and exploded perspective views of a first embodiment of a base or foundation that may be employed within the new and improved actuating mechanism or system as illustrated within FIGS. 2-5; and FIGS. 7A-7D are, respectively, side elevational, top plan, assembled perspective, and exploded perspective views of a second embodiment of a base or foundation that may be employed within the new and improved actuating mechanism or system as illustrated within FIGS. 2-5.

DETAILED DESCRIPTIONS OF THE ILLUSTRATED EMBODIMENTS

Referring now to the drawings, and more particularly to FIG. 1 thereof, a conventional, PRIOR ART, powered furniture seating piece, which may be utilized within home offices, family rooms, dens, and the like, business offices or conference rooms, or theater or stadium seating environments, is disclosed and is generally indicated by the reference character 100. More particularly, for the purposes of this disclosure, the powered furniture seating piece 100 comprises a seat section 110, a back section 120, and an ottoman or footrest section 130, all of which are adapted to be moved between a first non-deployed position at which, for example, the seat section 110 is disposed so as to have a substantially horizontal orientation, the back section 120 is disposed at a fully upright position, and the ottoman or footrest section 130 is disposed at a retracted or closed position, and a second deployed position at which, for example, the seat section 110 is disposed so as to have a tilted orientation with the front of the seat section being elevated while the rear of the seat section is lowered, the back support 120 is disposed at a fully reclined position, and the ottoman or footrest section 130 is disposed at an extended or open position. A suitable actuating mechanism or system is then incorporated within the powered furniture seating piece 100 such that the seat section 110, the back support 120, and the ottoman or footrest section 130 are moved between the first non-deployed position and the second deployed position.

With reference now being made to FIGS. 2-5, a new and improved actuating mechanism or system, for use in connection with the powered furniture seating piece 100 of FIG. 1, is disclosed and is generally indicated by the reference character 200. More particularly, the new and improved actuating mechanism or system 200 is seen to comprise a base or foundation 202, and a linear actuator 204 having its motor or rear end 206 pivotally mounted upon the base or foundation 202 by means of a first suitable clevis connection 208, while its oppositely disposed telescopic rod or forward end 210 is pivotally connected, by means of a second suitable clevis connection 212, to a front motor drive tube 214 which is mounted upon an ottoman drive link 216 that has a first end portion thereof pivotally mounted upon a seat rail 218 as at 217. An upstanding back support 220 is integrally or otherwise fixedly connected to the rear end portion of the seat rail 218, and it is noted that the linear actuator 204 may be a mechanical actuator, an electrical actuator, a hydraulic actuator, a pneumatic actuator, or any suitable combination thereof, such as, for example, an electromechanical actuator.

Continuing further, a rear pivot link 222 is pivotally connected at a first end thereof to a rear portion of the seat rail 218, as at 224, while a second opposite end thereof is pivotally connected to or mounted upon the base or foundation 202 as at 226. In a similar manner, a front pivot link 228 is pivotally connected at a first end thereof to an intermediate portion of the seat rail 218, as at 230, while a second opposite end thereof is pivotally connected to or mounted upon a front-end portion of the base or foundation 202 as at 232. This structural interrelationship permits the seat rail 218 to effectively slide forwardly and backwardly, with respect to the fixed base or foundation 202, when the components of the powered furniture seating 100, such as, for example, the seat section 110 and the back support 120 fixedly connected to the seat section 110, and the extendable footrest or leg support 130, are moved between a first position or state at which the seat section 110 and the back support 120 are not tilted or reclined, while the footrest or leg support 130 is disposed at a retracted or closed position, and a second position at which the seat section 110 and the back support 120 are disposed at tilted and reclined positions while the footrest or leg support 130 is disposed at an extended or fully open position. Still further, a control link 234 is pivotally connected at a first end thereof to an intermediate portion of the front pivot link 228 as at 236, while a second opposite end thereof is pivotally connected to a first end portion of an ottoman control link 238 as at 240.

A first end portion of the ottoman control link 238 is pivotally connected to or mounted upon the seat rail 218, at a location near the front-end portion of the seat rail 218, as at 242, while a second opposite end portion of the ottoman control link 238 is pivotally connected to a first end portion of a first ottoman extension link 244 as at 246, a second opposite end portion of the first ottoman extension link 244 being pivotally connected to a first end portion of an ottoman mounting or support bracket 248, as at 250, upon which the ottoman or footrest or leg support section 130 is to be mounted and supported. In turn, an intermediate portion of the first ottoman extension link 244 is pivotally connected to an intermediate portion of the ottoman drive link 216 as at 252, while a second end portion of the ottoman drive link 216 is pivotally connected to a first end portion of a second ottoman extension link 254 as at 256, a second opposite end portion of the second ottoman extension link 254 being pivotally connected to an intermediate portion of the ottoman mounting or support bracket 248, as at 258, upon which the ottoman or footrest or leg support 130 is to be mounted and supported. Therefore, as will be described in greater detail hereinafter, it can be readily appreciated that as a result of the extension or contraction of the telescopic rod 210 of the linear actuator 204, the components of the powered furniture seating 100, that is, the seat section 110 and the back support 120 fixedly connected to the seat section 110, and the extendable footrest or leg support 130, are capable of being moved between the first position or state at which the seat section 110 and the back support 120 are not tilted or reclined, while the footrest or leg support 130 is disposed at a retracted or closed position, and the second position at which the seat section 110 and the back support 120 are disposed at tilted and reclined positions while the footrest or leg support 130 is disposed at an extended or fully open position, and, in addition, the seat rail 218 is effectively enabled to slide forwardly and backwardly, with respect to and upon the fixed base or foundation 202, when the components of the powered furniture seating 100 are moving or traversing between the first and second positions.

Having described substantially all of the operative components of the new and improved actuating mechanism or system 200, for use in connection with the powered furniture seating piece 100 of FIG. 1, a brief description of the operation of the same will now be set forth. More particularly, with reference being made to FIGS. 3 and 5, the new and improved actuating mechanism or system 200 being disclosed as being disposed in its first state or retracted position at which the seat section 110 is disposed so as to have a substantially horizontal orientation, the back support 120 is disposed at its fully upright position, and the ottoman or footrest section 130 is disposed at a retracted or closed position, then when the linear actuator 204 is actuated such that the telescopic rod 210 thereof is extended, the front motor drive tube 214 will be forced to move forwardly so as to, in turn, cause the ottoman drive link 216 to move forwardly and upwardly as a result of its pivotal connection upon the seat rail 218 as at 217. The forward and upward movement of the ottoman drive link 216 thus causes the first and second ottoman extension links 244,254 to move forwardly and upwardly, thereby moving the ottoman mounting or support bracket 248 to its extended position. In addition, it is to also be appreciated that as the ottoman drive link 216 is being moved forwardly and upwardly, the ottoman control link 238 is also moved forwardly and upwardly as a result of the pivotal interconnection of the ottoman control link 238 with the first ottoman extension link 244 and the ottoman drive link 216.

Still further, this forward and upward movement of the ottoman control link 238, as a result of its pivotal connection upon the seat rail 218 as at 242, will cause the free end portion thereof to undergo clockwise rotation whereby the control link 234 will undergo counterclockwise rotation as a result of the pivotal connection defined between the ottoman control link 238 and the control link 234 as at 240. In turn, as a result of the counterclockwise rotation of the control link 234, the upper end portion of the control link 234 will effectively move downwardly while the lower end portion of the control link 234 will effectively move upwardly so as to, in turn, cause the front pivot link 228 to rotate in the counterclockwise direction thereby causing the seat rail 218 to move upwardly or be elevated, to an inclined position, as well as to cause the seat rail 218 to move or slide forwardly. This forward sliding movement of the seat rail 218 will, in turn, cause the pivotal, counterclockwise movement of the rear pivot link 222. It is of course to be appreciated that reverse movements of all of the noted components will occur when the telescopic rod 210 of the linear actuator 204 is retracted so as to move the seat section 110, the back support 120, and the ottoman or footrest section 130 from their inclined, reclined, and extended or open positions back to their substantially horizontal, fully upright, and retracted or closed positions.

With reference lastly being made to FIGS. 6A-6D and 7A-7D, two embodiments of a base or foundation, similar to base or foundation 202, are disclosed and will now be described. A conventional, PRIOR ART base is disclosed within the aforenoted U.S. Pat. No. 10,213,020 which issued to Lawson on Feb. 26, 2019. In accordance with this patented base, the various structural components thereof are welded together. Accordingly, if they are to be shipped or transported, they are difficult, cumbersome, and expensive to do so om view of the bulk volume that they encompass. In addition, if a component part of the overall structure is damaged or otherwise needs to be replaced, the entire base structure must be replaced in view of the fact that it would be difficult and costly to try to replace only a portion or section of the welded structure. Accordingly, a need in the art has required a new and improved base or foundation for use with powered seating furniture features. As can therefore be appreciated from FIGS. 6A-6D, a first embodiment of such a new and improved base or foundation is generally indicated by the reference character 202-1 and is seen to comprise a pair of oppositely disposed sidewall mounting brackets 260-1,260-1, and a pair of oppositely disposed, front and rear, laterally or transversely extending support tubes 262-1,262-1. Each one of the oppositely disposed sidewall mounting brackets 260-1,260-1 is provided with a rear, horizontally extending flanged mounting bracket 264-1,264-1, only one of which can be seen, to which the opposite ends of the rear support tube 262-1 can be bolted or otherwise fastened by means of bolt fasteners 266-1 or the like. In a similar manner, each one of the oppositely disposed sidewall mounting brackets 260-1,260-1 is also provided with a forward, vertically extending flanged mounting bracket 268-1,268-1, only one of which can be easily seen, to which the opposite ends of the front support tube 262-1 can be bolted or otherwise fastened by means of bolt fasteners 270-1,270-1 or the like.

Still yet further, it is lastly seen that the base or foundation 202-1 is adapted to be supported upon four leg members comprising two rear support legs 272-1,272-1, and two front support legs 274-1,274-1 which are adapted to be fixedly connected to undersurface portions of the base or foundation 202-1 within the four corner regions of the base or foundation 202-1. More particularly, it is seen that each one of the rear support legs 272-1,272-1 has a substantially Z-shaped configuration wherein a lower, horizontally oriented flanged portion 276-1 is provided with a through bore 278-1 for receiving a bolt fastener or the like by means of which the support leg 272-1 can be fixedly secured to a floor or platform, not shown, upon which the base or foundation 202-1 is to be mounted, while an upper, horizontally oriented flanged portion 280-1 is provided with a pair of through-bores 282-1 for receiving the bolt fasteners 266-1. It will therefore be appreciated that in accordance with this unique structural assembly, the bolt fasteners 266-1 not only fixedly secure the rear support legs 272-1,272-1 to undersurface portions of the rear support tube 262-1, but the same bolt fasteners 266-1 also fixedly secure opposite ends of the rear support tube 262-1 to undersurface portions of the rear flanged mounting brackets 264-1,264-1. In a similar manner, it is seen that each one of the front support legs 274-1,274-1 has a substantially Z-shaped configuration wherein a lower, horizontally oriented flanged portion 284-1 is provided with a through bore 286-1 for receiving a bolt fastener or the like by means of which the support leg 274-1 can be fixedly secured to the floor or platform, not shown, upon which the base or foundation 202-1 is to be mounted, while an upper, vertically oriented flanged portion 288-1 is provided with a pair of through-bores 290-1 for receiving the bolt fasteners 270-1. It will therefore be appreciated that in accordance with this unique structural assembly, the bolt fasteners 270-1 not only fixedly secure the opposite ends of the front support tube 262-1 to front surface portions of the front flanged mounting brackets 268-1,268-1, but, in addition, the bolt fasteners 270-1 fixedly secure the front support legs 274-1, 274-1 to rear surface portions of the front support tube 262-1. It is lastly to be appreciated that this first embodiment of the new and improved base or foundation 202-1 is adapted to be mounted upon a level or horizontally oriented floor or platform.

With reference now being made to FIGS. 7A-7D, a second embodiment of a new and improved base or foundation is generally indicated by the reference character 202-2 and is noted as being structurally similar to the first embodiment of the new and improved base or foundation 202-1, as disclosed within FIGS. 6A-6D, except as will be noted. More particularly, the second embodiment of the new and improved base or foundation 202-2 is seen to comprise a pair of oppositely disposed sidewall mounting brackets 260-2,260-2, and a pair of oppositely disposed, front and rear, laterally or transversely extending support tubes 262-2,262-2. Each one of the oppositely disposed sidewall mounting brackets 260-2,260-2 is provided with a rear, horizontally extending flanged mounting bracket 264-2,264-2, only one of which can be seen, to which the opposite ends of the rear support tube 262-2 can be bolted or otherwise fastened by means of bolt fasteners 266-2 or the like. In a similar manner, each one of the oppositely disposed sidewall mounting brackets 260-2,260-2 is also provided with a forward, vertically extending flanged mounting bracket 268-2,268-2, only one of which can be easily seen, to which the opposite ends of the front support tube 262-2 can be bolted or otherwise fastened by means of bolt fasteners 270-2, 270-2 or the like. Still yet further, it is lastly seen that the base or foundation 202-2 is adapted to be supported upon four leg members 272-2,272-2,272-2,272-2 which are adapted to be adjustably connected to undersurface portions of the base or foundation 202-2 within the four corner regions of the base or foundation 202-2. More particularly, it is seen that each one of the support legs 272-2,272-2,272-2,272-2 comprises a horizontally oriented plate member 274-2 within which a through bore, not visible, is provided such that a bolt fastener or the like, not shown, can fixedly secure each one of the four support legs 272-2,272-2,272-2,272-2 to a floor or platform, not shown, upon which the base or foundation 202-1 is to be mounted. In addition, a lower end portion of an upstanding, externally threaded rod 276-2 is threadedly engaged within each horizontally oriented plate member 274-2, and an internally threaded adjustment nut 278-2 is threadedly mounted upon each upstanding, externally threaded rod 276-2.

Still further, it is seen that a pair of horizontally oriented, rear mounting brackets 280-2,280-2 are each provided with an upstanding boss member 282-2 for receiving an upper free end portion of one of the upstanding support legs 272-2, the adjustment nut 278-2 being utilized to abut the undersurface portion of the mounting bracket 280-2 so as to maintain the same at a predeterminedly desired adjustment height when the adjustment nut 278-2 is threadedly adjusted along the externally threaded shaft portion of the upstanding support leg 272-2. In addition, it is also seen that each one of the mounting brackets 280-2,280-2 is provided with a pair of through-bores 283-2, 283-2 for receiving the bolt fasteners 266-2. It will therefore be appreciated that in accordance with this unique structural assembly, the bolt fasteners 266-2 not only fixedly secure the rear mounting brackets 280-2, 280-2 to undersurface portions of the rear support tube 262-2, but the same bolt fasteners 266-2 also fixedly secure opposite ends of the rear support tube 262-2 to undersurface portions of the rear flanged mounting brackets 264-2,264-2. In a similar manner, it is seen that each one of a pair of horizontally oriented, front mounting brackets 284-2, 284-2 is provided with a boss 286-2 for receiving the upper free end portion of one of the upstanding externally threaded support legs 272-2, while a vertically oriented flanged portion 288-2 is provided with a pair of through-bores 290-2 for receiving the bolt fasteners 270-2. It will therefore be appreciated that in accordance with this unique structural assembly, the bolt fasteners 270-2 not only fixedly secure the opposite ends of the front support tube 262-2 to front surface portions of the front flanged mounting brackets 268-2,268-2, but, in addition, the bolt fasteners 270-2 fixedly secure the front mounting brackets 284-2,284-2 to rear surface portions of the front support tube 262-2. It is lastly to be appreciated that this first embodiment of the new and improved base or foundation 202-1 is adapted to be mounted upon a sloped or inclined floor or platform.

Obviously, many variations and modifications of the present invention are possible in light of the above teachings. It is therefore to be understood that within the scope of the appended claims, the present invention may be practiced otherwise than as specifically described herein.

What is claimed as new and desired to be secured by Letters Patent is:

1. An actuating mechanism for a powered furniture piece, comprising:

a base or foundation;

a seat rail, for supporting a seat section of said furniture piece, operatively connected to said base or foundation;

a back support, fixedly connected to said seat rail, for supporting a back section of said furniture piece;

a footrest mounting bracket for supporting a footrest section of said furniture piece;

an ottoman drive link pivotally mounted upon said seat rail and operatively connected to said footrest mounting bracket; and a linear actuator connected to said ottoman drive link such that when said linear actuator is actuated to an extended position, said ottoman drive link will cause said footrest mounting bracket to be moved from a retracted closed position to an extended open position, said ottoman drive link will cause said seat rail to be moved from a substantially horizontal position to an inclined position, and said ottoman drive link will cause said back support to be moved from a fully upright position to a fully reclined position.

2. The actuating mechanism as set forth in claim 1, wherein:

said linear actuator is connected to said ottoman drive link such that when said linear actuator is actuated to an extended position, said ottoman drive link will cause said seat rail to be moved from a substantially horizontal position to an inclined position at which a front portion of said seat rail is elevated while a rear portion of said seat rail is lowered.

3. The actuating mechanism as set forth in claim 1, further comprising:

a front pivot link connecting said seat rail to said base or foundation; and said linear actuator is connected to said ottoman drive link such that when said linear actuator is actuated to an extended position, said ottoman drive link, in conjunction with said front pivot link, will cause said seat rail to be moved from a substantially horizontal position to an inclined position at which a front portion of said seat rail is elevated while a rear portion of said seat rail is lowered.

4. The actuating mechanism as set forth in claim 1, further comprising:

a front pivot link connecting said seat rail to said base or foundation; and said linear actuator is connected to said ottoman drive link such that when said linear actuator is actuated to a retracted position, said ottoman drive link, in conjunction with said front pivot link, will cause said seat rail to be moved from an inclined position, at which a front portion of said seat rail is elevated while a rear portion of said seat rail is lowered, to a substantially horizontal position.

5. The actuating mechanism as set forth in claim 1, further comprising:

a front pivot link connecting said seat rail to said base or foundation;

a rear pivot link connecting said seat rail to said base or foundation; and said linear actuator is connected to said ottoman drive link such that when said linear actuator is actuated to an extended position, said ottoman drive link, in conjunction with said front and rear pivot links, will cause said seat rail to be slide forwardly relative to said base or foundation.

6. The actuating mechanism as set forth in claim 1, further comprising:

a front pivot link connecting said seat rail to said base or foundation;

a rear pivot link connecting said seat rail to said base or foundation; and said linear actuator is connected to said ottoman drive link such that when said linear actuator is actuated to a retracted position, said ottoman drive link, in conjunction with said front and rear pivot links, will cause said seat rail to be slide rearwardly relative to said base or foundation.

7. The actuating mechanism as set forth in claim 1, wherein:

said base or foundation comprises a plurality of structural components which are bolted together.

8. The actuating mechanism as set forth in claim 7, wherein:

said base or foundation comprises a plurality of non-adjustable support legs for permitting said base or foundation to be mounted upon a level floor or platform.

9. The actuating mechanism as set forth in claim 7, wherein:

said base or foundation comprises a plurality of adjustable support legs for permitting said base or foundation to be mounted upon a sloped or inclined floor or platform.

10. The actuating mechanism as set forth in claim 7, wherein said base or foundation comprises:

a plurality of support legs for permitting said base or foundation to be mounted upon a floor or platform;

a pair of oppositely disposed sidewall mounting brackets;

a front support tube and a rear support tube;

a first set of bolt fasteners fixedly securing a first pair of said plurality of support legs to said front support tube while simultaneously fixedly securing said front support tube to front portions of said pair of oppositely disposed sidewall mounting brackets; and a second set of bolt fasteners fixedly securing a second pair of said plurality of support legs to said rear support tube while simultaneously fixedly securing said rear support tube to rear portions of said pair of oppositely disposed sidewall mounting brackets.

11. A powered furniture seating piece, comprising:

a base or foundation;

a seat rail, for supporting a seat section of said furniture piece, operatively connected to said base or foundation;

a back support, fixedly connected to said seat rail, for supporting a back section of said furniture piece;

a footrest mounting bracket for supporting a footrest section of said furniture piece;

an ottoman drive link pivotally mounted upon said seat rail and operatively connected to said footrest mounting bracket; and a linear actuator connected to said ottoman drive link such that when said linear actuator is actuated to an extended position, said ottoman drive link will cause said footrest mounting bracket to be moved from a retracted closed position to an extended open position, said ottoman drive link will cause said seat rail to be moved from a substantially horizontal position to an inclined position, and said ottoman drive link will cause said back support to be moved from a fully upright position to a fully reclined position.

12. The powered furniture seating piece as set forth in claim 11, wherein:

said linear actuator is connected to said ottoman drive link such that when said linear actuator is actuated to an extended position, said ottoman drive link will cause said seat rail to be moved from a substantially horizontal position to an inclined position at which a front portion of said seat rail is elevated while a rear portion of said seat rail is lowered.

13. The powered furniture seating piece as set forth in claim 11, further comprising:

a front pivot link connecting said seat rail to said base or foundation; and said linear actuator is connected to said ottoman drive link such that when said linear actuator is actuated to an extended position, said ottoman drive link, in conjunction with said front pivot link, will cause said seat rail to be moved from a substantially horizontal position to an inclined position at which a front portion of said seat rail is elevated while a rear portion of said seat rail is lowered.

14. The powered furniture seating piece as set forth in claim 11, further comprising:

a front pivot link connecting said seat rail to said base or foundation; and said linear actuator is connected to said ottoman drive link such that when said linear actuator is actuated to a retracted position, said ottoman drive link, in conjunction with said front pivot link, will cause said seat rail to be moved from an inclined position, at which a front portion of said seat rail is elevated while a rear portion of said seat rail is lowered, to a substantially horizontal position.

15. The powered furniture seating piece as set forth in claim 11, further comprising:

a front pivot link connecting said seat rail to said base or foundation;

a rear pivot link connecting said seat rail to said base or foundation; and said linear actuator is connected to said ottoman drive link such that when said linear actuator is actuated to an extended position, said ottoman drive link, in conjunction with said front and rear pivot links, will cause said seat rail to be slide forwardly relative to said base or foundation.

16. The powered furniture seating piece as set forth in claim 11, further comprising:

a front pivot link connecting said seat rail to said base or foundation;

a rear pivot link connecting said seat rail to said base or foundation; and said linear actuator is connected to said ottoman drive link such that when said linear actuator is actuated to a retracted position, said ottoman drive link, in conjunction with said front and rear pivot links, will cause said seat rail to be slide rearwardly relative to said base or foundation.

17. The powered furniture seating piece as set forth in claim 11, wherein:

said base or foundation comprises a plurality of structural components which are bolted together.

18. The powered furniture seating piece as set forth in claim 17, wherein:

said base or foundation comprises a plurality of non-adjustable support legs for permitting said base or foundation to be mounted upon a level floor or platform.

19. The powered furniture seating piece as set forth in claim 17, wherein:

said base or foundation comprises a plurality of adjustable support legs for permitting said base or foundation to be mounted upon a sloped or inclined floor or platform.

20. The powered furniture seating piece as set forth in claim 17, wherein said base or foundation comprises:

a plurality of support legs for permitting said base or foundation to be mounted upon a floor or platform;

a pair of oppositely disposed sidewall mounting brackets;

a front support tube and a rear support tube;

a first set of bolt fasteners fixedly securing a first pair of said plurality of support legs to said front support tube while simultaneously fixedly securing said front support tube to front portions of said pair of oppositely disposed sidewall mounting brackets; and a second set of bolt fasteners fixedly securing a second pair of said plurality of support legs to said rear support tube while simultaneously fixedly securing said rear support tube to rear portions of said pair of oppositely disposed sidewall mounting brackets.

* * * * *